US010731543B2

(12) United States Patent
Maiello et al.

(10) Patent No.: US 10,731,543 B2
(45) Date of Patent: Aug. 4, 2020

(54) METHOD TO DETERMINE THE USE OF A BLOCK HEATER

(71) Applicant: DELPHI AUTOMOTIVE SYSTEMS LUXEMBOURG SA, Bascharage (LU)

(72) Inventors: Eduardo Maiello, Luxembourg (LU); Erik Schoof, Bertrange (LU); Loic Gandolfi, Differdange (LU); Luca Tascedda, Puttelange les Thionville (FR)

(73) Assignee: DELPHI AUTOMOTIVE SYSTEMS LUXEMBOURG SA, Bascharage (LU)

( * ) Notice: Subject to any disclaimer, the term of this patent is extended or adjusted under 35 U.S.C. 154(b) by 0 days.

(21) Appl. No.: 16/439,810

(22) Filed: Jun. 13, 2019

(65) Prior Publication Data

US 2019/0383205 A1 Dec. 19, 2019

(30) Foreign Application Priority Data

Jun. 13, 2018 (GB) ..... 1809665.1

(51) Int. Cl.
*F01P 11/14* (2006.01)
*F02N 19/10* (2010.01)

(52) U.S. Cl.
CPC ..... *F01P 11/14* (2013.01); *F02N 19/10* (2013.01)

(58) Field of Classification Search
CPC .. F01P 11/14; F02N 19/10; F02D 2200/0414; F02D 41/222; F02D 41/064; F02D 41/06; F02D 41/068
See application file for complete search history.

(56) References Cited

U.S. PATENT DOCUMENTS

| | | | | |
|---|---|---|---|---|
| 5,781,877 | A * | 7/1998 | Rachel | F02D 41/064 701/104 |
| 6,931,865 | B1 | 8/2005 | Van Gilder et al. | |
| 7,277,791 | B2 | 10/2007 | Petrosius et al. | |
| 7,524,106 | B2 | 4/2009 | Higashiyama et al. | |
| 7,757,649 | B2 | 7/2010 | Wakahara | |
| 7,975,536 | B2 | 7/2011 | Bommer et al. | |
| 8,140,246 | B1 | 3/2012 | Manchanda | |
| 8,166,808 | B2 * | 5/2012 | Bialas | F02D 41/222 73/114.68 |
| 8,538,623 | B2 * | 9/2013 | Eser | F01P 11/16 701/30.8 |
| 8,695,552 | B2 | 4/2014 | Onozawa et al. | |
| 8,978,598 | B2 | 3/2015 | Iwai | |
| 2004/0044462 | A1 * | 3/2004 | Linenberg | F01P 11/20 701/113 |

(Continued)

FOREIGN PATENT DOCUMENTS

| | | | |
|---|---|---|---|
| JP | 2002030959 A | * | 1/2002 |
| JP | 2010101190 A | | 5/2010 |

*Primary Examiner* — Hung Q Nguyen
(74) *Attorney, Agent, or Firm* — Joshua M. Haines

(57) ABSTRACT

A method of determining whether a block heater has been used prior to starting an internal combustion engine includes monitoring the temperature with time of the intake air subsequent to the start of the engine. The method also includes determining whether there is a subsequent drop in the temperature after starting. If a temperature drop is determined, a parameter of the temperature drop with time is determined. If the parameter becomes larger than a predetermined threshold, block heater use is indicated.

4 Claims, 3 Drawing Sheets

(56) References Cited

U.S. PATENT DOCUMENTS

| | | | | |
|---|---|---|---|---|
| 2008/0163679 | A1* | 7/2008 | Viel | F02D 41/222<br>73/114.34 |
| 2008/0300774 | A1* | 12/2008 | Wakahara | F02D 35/025<br>701/113 |
| 2009/0182489 | A1* | 7/2009 | Yang | F02D 41/062<br>701/113 |
| 2009/0319162 | A1* | 12/2009 | Bommer | F02D 41/222<br>701/113 |
| 2010/0256892 | A1* | 10/2010 | Shartzer | F02D 41/062<br>701/104 |
| 2012/0055663 | A1* | 3/2012 | Onozawa | H05B 1/0236<br>165/266 |
| 2012/0318214 | A1* | 12/2012 | Iwai | F01P 11/16<br>123/41.15 |
| 2013/0058373 | A1* | 3/2013 | Sakurada | F02D 41/1446<br>374/4 |
| 2013/0213324 | A1* | 8/2013 | Saitoh | F01P 7/165<br>123/41.09 |
| 2016/0258343 | A1* | 9/2016 | Mushiga | F01P 7/162 |
| 2018/0266349 | A1* | 9/2018 | Almkvist | B60W 30/194 |

* cited by examiner

METHOD TO DETERMINE THE USE OF A BLOCK HEATER

CROSS-REFERENCE TO RELATED APPLICATIONS

This application claims priority to GB Patent Application No. 1809665.1 filed on Jun. 13, 2018, the disclosure of which is hereby incorporated by reference in its entirety.

TECHNICAL FIELD

The invention relates to a method of determining if a block heater has been used in an automobile engine. The methodology may be carried out by the engine ECU.

BACKGROUND OF THE INVENTION

In a conventional automobile, a block heater is a stand-alone accessory used to heat the coolant fluid inside the engine block or in any area of the coolant circuit. This device is mostly used in geographic regions with cold temperatures because heating the engine coolant can ease starting an engine.

The operation of an engine block heater, however, can disturb the on-board diagnostics (OBD) of rationality of temperature sensors, thus, there is a need for a method for detecting a presence of a block heater in an automobile.

Prior art methods for determining engine malfunctions have tried to determine whether a block heater is present and has been used by checking for a temperature difference between the engine coolant and the intake manifold air or ambient temperature, when the engine has been stopped for a minimum period; other methods have tried to determine the presence of the block heater by checking for a temperature drop in the engine coolant temperature after a period of time after engine start.

U.S. Pat. No. 6,931,865B1 describes a method and apparatus for determining coolant temperature rationality in a motor vehicle. U.S. Pat. No. 7,975,536B2 describes a method to detect the presence of a liquid-cooled engine supplemental heater. U.S. Pat. No. 8,140,246B1 describes a method and system for detecting a presence of a block heater in an automobile. U.S. Pat. No. 7,757,649B2 describes a controller, cooling system abnormality diagnosis device and block heater determination device of the internal combustion engine.

The methods of detection of a block heater used by the prior art are not reliable enough or cannot be used under certain circumstances. In case the coolant temperature sensor has a fault, detectable by OBD monitors, all the detection methods developed on prior art that rely only on this sensor cannot be used. In case the engine is equipped with an electronic controlled thermostat valve or a forced circulation block heater, that will allow the coolant fluid to circulate over the entire cooling circuit, allowing a homogenous distribution of the temperature on the system, the detection methods based on a drop of the coolant temperature after engine start are not always reliable, as the coolant temperature might not drop, since the coolant temperature on the system was homogeneously distributed. On both circumstances the methods of detection developed on the prior art are not able to guarantee a reliable detection of the block heater.

Because the problems with the prior art are present on more advanced engines which use electronic controlled thermostat valves, which allow the coolant fluid to flow through all the coolant circuit independent of the coolant fluid temperature, these valves are yet only used on few engines because they were developed recently, on the next years they might become common on several engines.

The problem is also present on engines that are equipped with forced circulation block heaters, which usually have a pump to force the coolant to flow through the system in order to have a better or more homogeneous temperature distribution on the coolant circuit, which will also prevent the prior art to detect the presence of a block heater.

The conventional methods are dependent on the relative position of the engine coolant temperature sensor relative to the block heater. However, these conventional methods can be inadequate depending on the configuration of the automobile and/or the placement of the block heater.

SUMMARY OF THE INVENTION

In one aspect is provided a method of determining whether a block heater has been used prior to starting an internal combustion engine comprising:

a) monitoring the temperature with time of the intake air T subsequent to the start of the engine;

b) determining whether there is a subsequent drop in said temperature after starting;

c) if a temperature drop is determined in step b), determining a parameter of the temperature drop with time;

d) determining if said parameter becomes larger than a predetermined threshold (thr1/thr2); and e) if step d) is fulfilled, indicating a block heater has been used.

Said parameter may be the drop in temperature from the initial start temperature (T1−T); and in step d) comprising determining if this drop is more than a predetermined threshold value (thr1).

The method may include the step of integrating the temperature difference (Tref2−T) between a reference temperature Tref2 and the measured temperature T, between first and second time points (ts, te), to provide an integral value, said integral value being the parameter determined in step c).

BRIEF DESCRIPTION OF DRAWINGS

The present invention is now described by way of example with reference to the accompanying drawings in which.

DESCRIPTION OF THE PREFERRED EMBODIMENTS

The present invention relates to a method for detecting a presence of a block heater in an automobile, based on monitoring the behavior of the inlet air temperature during cranking and running phases of the engine.

The invention detecting the use of a block heater even in applications in which no drop of the coolant temperature is noticed after engine start, due to the relative positions of the (engine coolant temperature) sensor and the block heater, or due to a homogenous distribution of the temperature of coolant fluid on the system, that can be seen on the most recent engines equipped with an electronic controlled thermostat valve and/or forced circulation block heater.

According to one aspect, the methodology monitors the intake manifold air temperature to detect the presence of a block heater. So, the problem of lack of robustness or incapacity of detecting the presence of a block heater in the engine is solved by using methodology that monitors the intake manifold air which is also reliable when used on engines equipped with electronic controlled thermostat valves and/or forced circulation block heaters. Analysis of the temperature of the air intake allows determination of whether a block heater was used.

If a block heater has been used, while the coolant is being heated, the air around the engine is also heated, including the air trapped inside the intake manifold plenum. This phenomenon creates a heated mass of air that is accumulated inside the intake manifold plenum, that will be consumed by the engine once this is cranked and started. As a consequence, a fresh mass of air from the ambient will fill the intake manifold plenum and the reading of the intake manifold air temperature sensor will drop.

In a simple embodiment, after the engine has started, the air intake temperature is monitored and if it drops, it is determined that a block heater has been used. The determination may be made only if the engine has been off for more than a predetermined time. The determination may be made from engine start to a relatively short period, so from engine start to a predefined time thereafter. The determination may also be made from the engine start time and finished based on amount of fuel consumed since engine start, not purely based on time. The determination may be made only if the temperature of the air intake drops by more than a predetermined amount.

Figure 1A:
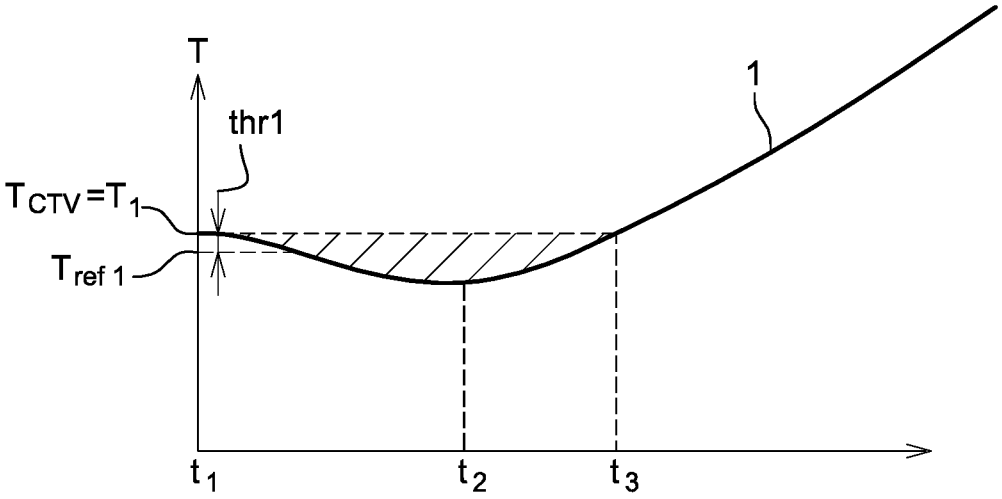
FIG. 1*a* shows the air intake temperature T of an engine after the engine has started (after cranking at time-point t1) against time of engine running, and a block heater has been previously used.

FIG. 1*a* shows a plot where reference numeral 1 shows the air intake temperature T of an engine after the engine has started (after cranking at time-point t1) against time of engine running, and a block heater has been previously used. As can be seen when a block heater has been used, after the start time at time t1 there is a drop in temperature to a local minimum at time point t2 and then it rises again. The temperature then increases and increases at time-point t3 to a level of that of time-point t1.

The "drop" phase, is to be regarded as the period between time points t1 and t3.

In a simple embodiment, any drop in temperature T from the initial start temperature T1 can determine i.e. indicate the previous use of a block heater. It may be a requirement for such a determination that the temperature drop exceeds a certain (threshold=thr1) amount; i.e. (T1−T)>thr1. In other words, an indication of a bock heater being used is determined if T falls to below Tref1 where Tref1 is T1−thr1. thr1 and Tref1 are shown in the figure.

In a refined (advanced) embodiment during any period of time within the time period of the drop phase, an integral of the difference between a set temperature Tref2 and the air intake temperature is determined, and when or if this exceeds a threshold the use of a block heater is determined. The value of Tref2 may be the initial temperature at T1, or may be set lower. In FIG. 1*a* the shaded area shows the integral in the drop phase where the difference between T1=Tref2, and the air intake temperature T is integrated from time t1. So, FIG. 1*a* shows a plot of air intake temperature 1 around the drop phase in more detail.

Figure 1B:
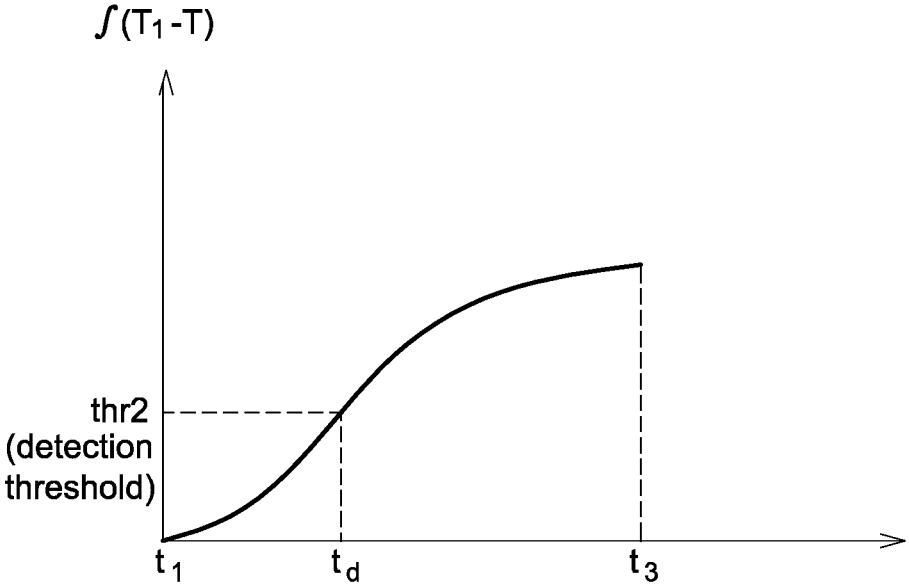
FIG. 1*b* shows, the integral value of (the constant temperature value (T1=Tref2) minus the temperature of the air intake (T))

FIG. 1*b* shows, the integral value of (the constant temperature value (T1=Tref2) minus the temperature of the air intake (T)) which in this example is determined from the time-point t1 (started at this point). In this case the reference temperature value Tref2 is the same as the temperature at point t1 (=T1). Thus, the bottom chart shows ∫(Tref2−T) or ∫(T1−T).

When this integral value reaches a threshold value thr2, at time-point td, the use of a block heater is determined. The bottom point shows the aforementioned integral value and it achieves a threshold value thr2 at time point td. If the threshold value is not achieved, because the magnitude/duration of the drop is small the detection of a block heater will not be triggered.

In general, the period of time over which the integral is determined starts at time point t1 or any time thereafter and finishes at a time point before time t3. If the integral becomes more than a threshold value, the use of a block heater is indicated. The integral may be determined until the time point t3 where the temperature rises up to the value of the initial temperature T1. The shaded area shows the integral value from time points t1 to t 3.

Refined Example

Figure 2:
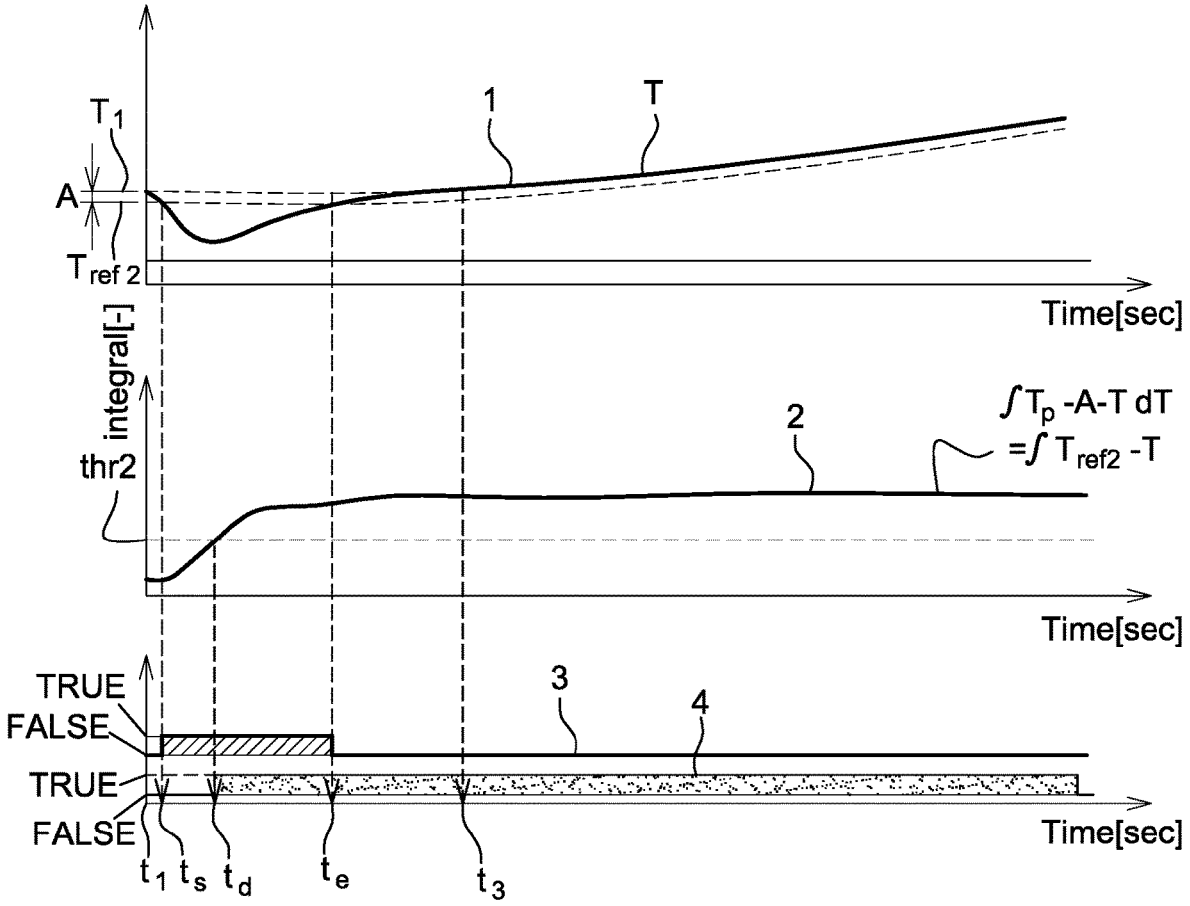
FIG. 2, illustrates an advanced embodiment in more detail where an offset A is used.

Referring to FIG. 2, the figure shows an advanced embodiment in more detail where an offset A is used in order to ignore small/shallow dips; i.e. a small drop region, to increase robustness. Here the value of the temperature T of the air intake at initial time-point t1 minus an offset value A is used to determine a constant temperature reference value (Tref2) and the difference between this Tref2 (constant value) and the air intake temperature is integrated, between any time points during the drop phase.

Preferably the integration is not started until the time point ts which is when the temperature of the intake air plenum T falls to value Tref2 which is (temperature at t1 (T1)−offset A). Thus, the integral value is determined from time-point ts.

Thus, the following integral is calculated, for a period during the drop phase:

Integral of intake air temperature drop=∫[(airintake temperature at $t1(T1)$−offset $A$)−current airintake temp temperature $T]dt$ or $\int((T1-A)-T)dt$ or $\int(\text{Tref2}-T)dt$ Again, if and when the value of this integral exceeds a calibratable threshold (thr2), the use of a block heater is confirmed.

Plot 2 shows the above reference integral value. As can be seen in the figure, the value of integral achieved the threshold value thr2 at time point td. At this point the use of a block heater is determined.

The shaded area of the top plot shows the integral value from time points ts and te, where ts is the start time of the integration when t=Tref2 and te is the end time of the integration where T goes back up to Tref2. It is to be noted that the threshold value to trigger block detection (thr2) may be achieved before te or that even at t3 the threshold value thr2 may not be reached.

The bottom two plots 3 and 4 of FIG. 2 show the logic in methodology. Plot 3 shows the logic resulting from the determination of whether the temperature drops by a predetermined amount, in this case the same as threshold A. If so, the logic signal indicates that there is a suspicion that a block heater may have been used. This is similar logic therefore as that of the method referring to FIG. 1. Plot 4 shows the logic from the determination above i.e. if the integral is above a threshold. If this is so than the suspicion that a bock heater may have been used is decided or confirmed. This arises at time td in the figure.

Figure 3:
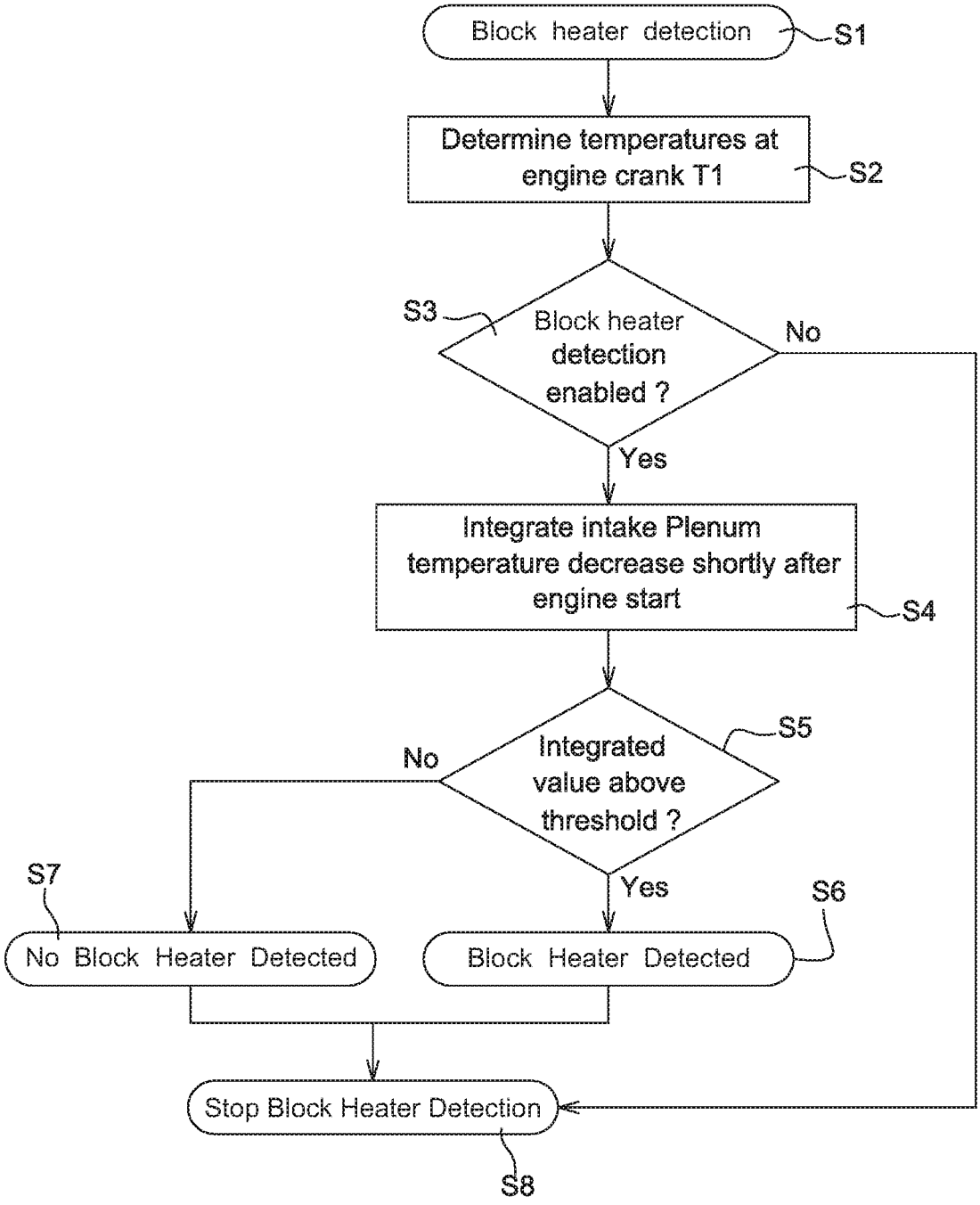
FIG. 3 shows a flowchart of one example of the methodology.

FIG. 3 shows a flowchart of one example of the methodology. In step S1 the block heater detection starts. In step S2 the temperature of the coolant T1 at engine start (crank) is determined. At step S3 it is determined whether the block heater detection is to be enabled. This may be "no" if certain conditions are not fulfilled which will be described later, then the method will proceed to step S8. If "yes", the method proceeds to step S4 where the air intake plenum temperature drop is integrated. This integration may not be started until a short time after engine starts or when the air plenum temperature has dropped more than a certain amount. At step S5 it is determined whether the integral calculated at step S4 reaches or rises above a threshold value. If yes at step S6, it is determined a bock heater is detected. If not, then at step S7 it is determined that no block heater has been detected. The block heater detection is then ended at step S8.

Before running the above mentioned methodology, there may be a check to ensure there are no faults with the temperature sensor, whether the engine has been off for more than a predetermined time, whether the engine has stopped more times than a threshold number. Before carrying out the check when the engine has started there may be a check to determine if there has been sufficient soak time. There may be a test to see whether the engine has been running for sufficient time e.g./by seeing if the fuel quantity injected since engine start up (crank) is sufficiently more than a predetermined threshold. There may be a check to see whether the measured temperature of the air intake is different enough (e.g. by a threshold) from the ambient temperature.

In the prior art, the detection of a block heater was only based on verification of differences between the readings of coolant and air temperature sensors before engine was cranked or started, which is not always possible to be differentiated from OBD-II rationality errors on the sensors. This invention uses an algorithm that evaluates the behavior of the intake manifold air temperature during engine cranking and running phase to effectively determine if a block heater was present or not. The detection is also reliable when the engine is equipped with electronic controlled thermostat valves and/or forced circulation block heaters, which will prevent the methods used by prior art from detecting the presence of a block heater. The advantage of this invention compared to the prior art is the improvement in the robustness of the detection of the presence of a block heater on the engine by using an efficient algorithm to verify the behavior of the ambient, coolant and intake air temperatures also during the engine cranking and starting phases. This invention can also be used on engines equipped with electronic controlled thermostat valves and/or forced circulation block heaters, which are recent technologies and will be used on several engines in the future.

We claim:

1. A method of determining whether a block heater has been used prior to starting an internal combustion engine, the method comprising;

a) measuring the temperature with time of intake air subsequent to start of the internal combustion engine;

b) determining whether there is a subsequent drop in said temperature after starting;

c) if a temperature drop is determined in step b), determining a parameter of the temperature drop with time;

d) determining if said parameter becomes larger than a predetermined threshold; and e) if step d) is fulfilled, indicating a block heater has been used;

wherein a temperature difference between a reference temperature and the measured temperature T, between first and second time points, is integrated to provide an integral value, said integral value being the parameter determined in step c).

2. A method as claimed in claim 1, wherein the reference temperature is the start temperature.

3. A method as claimed in claim 1, wherein the reference temperature is the start temperature minus a fixed offset.

4. A method as claimed in claim 1, wherein integration starts when the temperature of the intake air drops to the level of the reference temperature and/or finishes when temperature of the intake air rises to the reference temperature.

* * * * *